United States Patent [19]

Porchet et al.

[11] Patent Number: 4,991,771

[45] Date of Patent: Feb. 12, 1991

[54] FUEL INJECTION VALVE

[75] Inventors: Frederic Porchet, Birchwil; Robert Hofer, Elgg, both of Switzerland

[73] Assignee: Sulzer Brothers Limited, Witnerthur, Switzerland

[21] Appl. No.: 385,653

[22] Filed: Jul. 27, 1989

[30] Foreign Application Priority Data

Aug. 10, 1988 [CH] Switzerland ..... 03019/88

[51] Int. Cl.[5] ..... F02M 53/04

[52] U.S. Cl. ..... 239/533.3; 239/600; 239/DIG. 19

[58] Field of Search ..... 239/132, 132.1, 132.3, 239/533.2-533.12, 596, 601, DIG. 19, 552, 600

[56] References Cited

U.S. PATENT DOCUMENTS 1,885,004 10/1932 Crumbaker ..... 239/533.9

2,886,014 5/1959 Konrad et al. ..... 239/533.3

4,266,729 5/1981 Kulke et al. ..... 239/533.12

FOREIGN PATENT DOCUMENTS 569731 11/1957 Italy ..... 239/533.3

*Primary Examiner*—Andres Kashnikow

*Assistant Examiner*—Karen B. Merritt

*Attorney, Agent, or Firm*—Kenyon & Kenyon

[57] ABSTRACT

The fuel injection valve is provided with a pair of ceramic rings in order to define a plurality of nozzles for injecting fuel into a combustion chamber. The two rings are mounted about an annular groove on an end of the valve body and communicate with a fuel delivery duct. The rings are mounted in place by threaded rings and intermediate rings with conical surfaces facing a conical surface of the valve body.

15 Claims, 1 Drawing Sheet

Fig.1
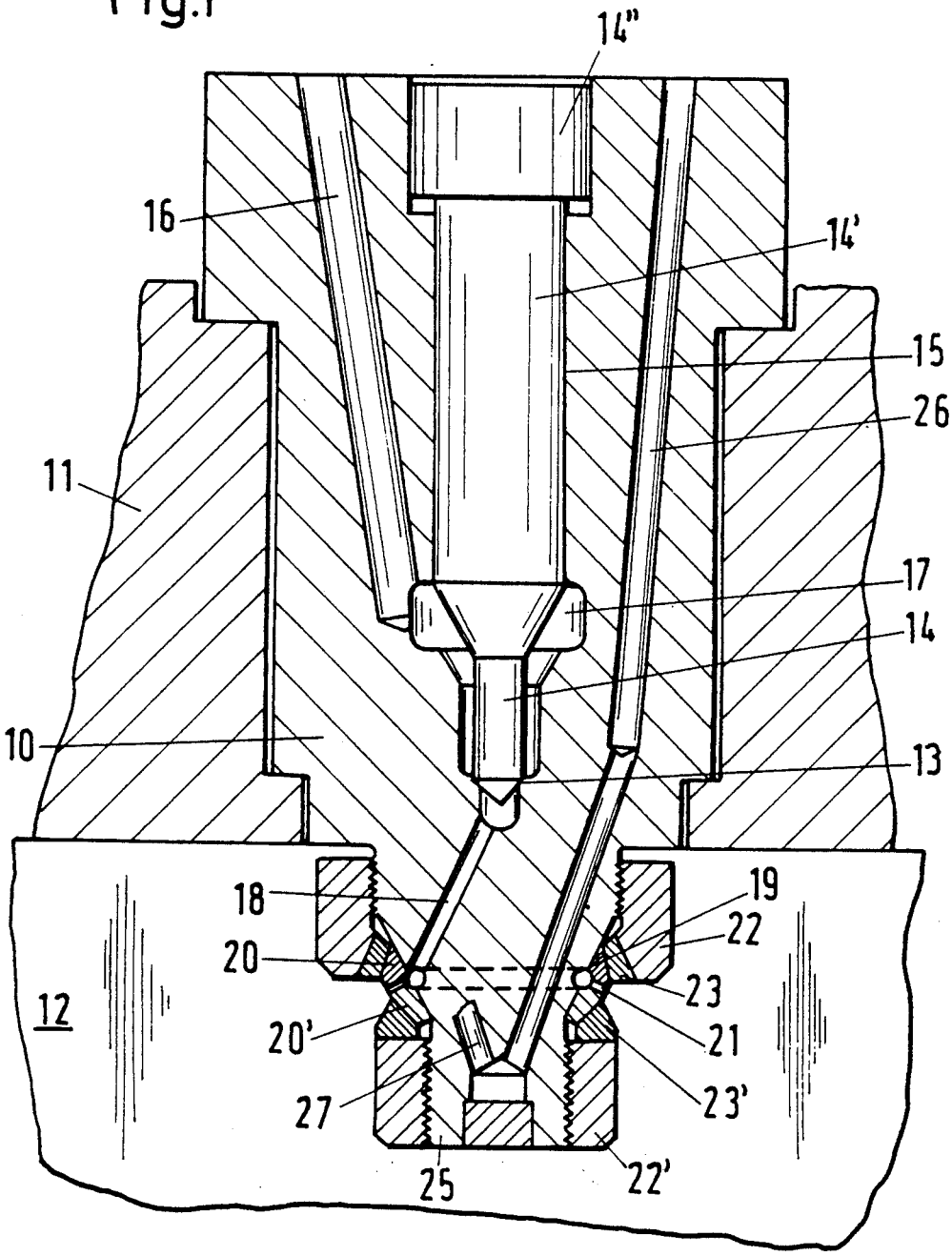
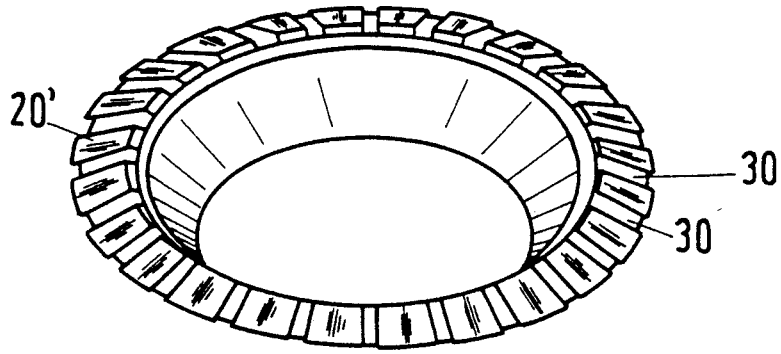
Fig.2

FUEL INJECTION VALVE

This invention relates to a fuel injection valve. More particularly, this invention relates to a fuel injection valve for reciprocating-piston internal combustion engines.

Heretofore, various types of injection valves have been known for use in reciprocating-piston internal combustion engines. Generally, such injection valves have been constructed of a valve body which can be mounted in a cover of a cylinder so as to project into a combustion chamber of the engine. In addition, the valve body contains a valve seat and at least one duct which connects a fuel supply to the valve seat, at least a second duct which leads from the valve seat to at least one nozzle opening in the end of the valve body in order to project a fuel jet into the combustion chamber and a movable valve needle for closing off the valve seat from time to time.

Usually, the nozzle opening is either formed in the actual valve body or in a separate head part which is connected to the valve body in a detachable manner, for example, by means of a cap nut. The material surrounding the nozzle opening usually consists of a steel alloy which is subject to a greater or lesser degree of wear due to erosion and corrosion. If the temperature in the combustion chamber of a diesel type internal combustion engine which are continuously operated with heavy oil is high enough, non-combustible constituents of the heavy oil may melt and, in the form of slag or oil ash, endanger the nozzle opening due to high-temperature corrosion. In addition, any impurities contained in the heavy oil may lead to damage due to erosion.

If an internal combustion engine is operated with a suspension of fine particle solid fuel in a liquid carrier, for example, a so-called coal slurry, the nozzle opening of such a fuel injection valve may soon become damaged by the abrasive effect of the solid fuel particles.

Accordingly, it is an object of the invention to reduce the damage due to wear of a nozzle in a fuel injection valve.

It is another object of the invention to provide a fuel injection valve with a nozzle for ejecting fuel which is corrosion resistant.

It is another object of the invention to increase the life of a fuel injection valve particularly for use in a reciprocating-piston internal combustion engine.

Briefly, the invention provides a fuel injection valve which is comprised of a valve body having an end for projecting into a combustion chamber, a valve seat and a duct extending from the valve seat to the end of the valve body in order to convey a flow of fuel thereto. In addition, the valve includes a valve needle which is movably mounted in the valve body for selectively seating on the valve seat in order to block a flow of fuel into the duct.

In accordance with the invention, the valve includes a pair of rings which are removably mounted about the valve body end in order to define at least one nozzle opening therebetween communicating with the duct in the valve body in order to exhaust a flow of fuel into the combustion chamber. The rings are disposed in contact with each other and have facing surfaces at least about the nozzle opening which are made of corrosion resistent material, that is, a material which is resistent to corrosion and/or erosion.

The formation of the nozzle opening by a pair of removable rings made of corrosion and/or erosion resistent material results in a considerable reduction in wear and damage. In this respect, the rings may be made of a ceramic material which is particularly suitable.

The fact that the nozzle opening is formed between two rings permits the nozzle opening to be produced in a simple and inexpensive manner particularly as the materials cannot normally be machined by processes usually employed for steel. In particular, holes cannot be bored in ceramic materials. In the present case, either the two rings are completely made of a ceramic material or the boundary surface of the nozzle opening is defined by a coating of ceramic material on the rings. Alternatively, the rings may be made of cermet.

These and other objects and advantages of the invention will become more apparent from the following detailed description taken in conjunction with the accompanying drawings wherein:

FIG. 1 illustrates a cross-sectional view of a fuel injection valve constructed in accordance with the invention within a cylinder; and FIG. 2 illustrates a perspective view of a ring forming a nozzle opening in accordance with the invention.

Referring to FIG. 1, the fuel injection valve comprises a valve body 10 which is arranged for mounting in a cylinder cover 11 with one end projecting into a combustion chamber 12, for example of a diesel-type reciprocating-piston internal combustion engine. The valve body 10 also has a valve seat 13 which cooperates with a valve needle 14 movably mounted in the valve body 10 for selectively seating on the valve seat 13. As indicated, the valve needle 14 may be moved up and down while being guided by way of a rod-like section 14' in a bore 15 in the valve body 10. The upper end of the section 14' is provided with a piston-like thickened part 14'' which, in turn, is acted upon by a helical spring (not shown) which pushes the valve needle 14 onto the valve seat 13. Alternatively, the closing force on the valve needle 14 may be applied by means of a controllable hydraulic pressure acting on the thickened part 14''.

The valve body 10 also has a fuel supply duct 16 which is connected at the upper end, as viewed, to a line (not shown) through which fuel which is to be injected passes at a high pressure from a fuel injection pump (not shown) to the injection valve. The duct 16 extends at the lower end, as viewed, into a chamber 17 which surrounds the valve needle 14 and extends as far as the valve seat 13. This chamber 17 is filled with fuel when the injection valve is in operation.

A further fuel duct 18 extends from the valve seat 13 to the end of the valve body 10 in order to convey a flow of fuel thereto. As indicated, the duct 18 terminates in an annular groove 19 provided in a conical surface about the end of the valve body.

A pair of rings 20, 20' are removable mounted about the valve body end in order to define at least one nozzle opening 21 therebetween which communicates with the duct 18 via the groove 19 in order to exhaust a flow of fuel into the combustion chamber 12. As indicated, the two rings rest against the conical surface of the valve body 10 on opposite ; sides of the annular groove 19.

The two rings 20, 20' consist of a ceramic material and are held in position on the valve body by means of a second pair of rings 22, 22', each of which is threaded, and a respective inserted intermediate ring 23, 23'. The upper threaded ring 22 which has the greater diameter is threaded onto a threaded projection of the valve body 10 disposed above the conical surface while the lower threaded ring 22′ is mounted on a threaded stem 25 of the valve body 10 below the conical surface of the valve body. The ceramic rings 20, 20′ are clamped between the intermediate rings 23, 23′ by screwing the threaded rings 22, 22′ in opposite directions. For this purpose, the contacting surfaces of the ceramic rings 20, 20′ and the intermediate rings 23, 23′, respectively, are of a conical shape so that the ceramic rings 20, 20′ are only subjected to pressure when resting against the conical surface of the valve body 10.

Referring to FIG. 2, the upper surface of the lower ceramic ring 20′ is conical and is provided with a plurality of straight grooves 30 which are distributed over the circumference of the ring 20′ and which have a rectangular cross-section. As indicated, the grooves 30 number twenty four. The grooves 30 are worked into the facing surface of the ceramic ring 20′, for example, by grinding. The associated ceramic ring 20 which is not shown in FIG. 2 has a surface of rotation which matches the upper surface of rotation of the ceramic ring 20′, extending in a flat manner, and in the assembled state rests closely against the upper surface of rotation of the ring 20′. That is, the upper ceramic ring 20 has a flat facing surface while the lower ceramic ring 20′ has grooves 30 facing the flat surface to define a plurality of nozzle openings 21. In the assembled state, the grooves 30 therefore form nozzle openings 21 of rectangular shape for producing jets of fuel into the combustion chamber 12.

Referring to FIG. 1, the valve body is also provided with cooling ducts 26, 27 which extend over the entire length of the valve body 10 and communicate with one another in the lower threaded stem 25. A plurality of cooling ducts of this kind may be distributed over the circumference of the valve body 10. Further, the coolant flows through the ducts 26, 27 in succession.

When the internal combustion engine is in operation, the fuel which is to be injected is supplied in a timed manner to the chamber 17 by way of the duct 16 at a pressure, for example, of 800 bar. The valve needle 14 is thus raised from the valve seat 13 against the closing pressure of the spring (not shown) which acts on the thickened part 14″ so that the fuel reaches the annular groove 19 by way of the duct 18. The fuel then disperses from the annular duct 19 and flows through the nozzle openings 21 as fuel jets to enter the combustion chamber 12 which is filled with compressed air. The needle 14 returns to the closed position when the pressure of the closing spring exceeds the fuel pressure in the chamber 17.

In an alternative construction, the area of the valve body 10 which surrounds the valve seat 13 may be formed as a separate component which is produced from a material which is particularly resistant to erosion and is inserted in the valve body 10. The needle 14 may also consist of a material of this kind which is then inserted in a corresponding bore in the rod-like section 14′. An embodiment of this kind if particularly appropriate if a suspension of a fine-particle solid fuel, such as coal, in a liquid, such as water or oil, is used as the fuel. Such a suspension is usually called a coal slurry.

Alternatively, the rings 20, 20′ may be formed of a metallic material which is unaffected by changes in temperature while the nozzle openings are formed by a surface coating of a ceramic or other hard erosion-resistant material which is applied to appropriately preformed openings between the two rings 20, 20′. The cross-section of the nozzle openings may also differ from a rectangular shape, and, for example, may be round. In this case, the contact surface between the two rings may be moved from the edge of the cross-section to the center of the cross-section. A composite material known by the term "cermet" may also be used to produce the rings 20, 20′.

The invention thus provides a fuel injection valve which is particularly resistant to corrosion and/or erosion. Further, the invention provides a fuel injection valve which can be readily disassembled to clean or replace the rings forming the nozzles openings.

What is claimed is:

1. A fuel injection valve comprising a valve body having an end for projecting into a combustion chamber, a valve seat and a duct extending from said valve seat to said end to convey a flow of fuel thereto;

a valve needle movably mounted in said valve body for selectively seating on said valve seat to block a flow of fuel into said duct;

a first pair of rings removably mounted about said valve body end to define at least one nozzle opening therebetween communicating with said duct to exhaust a flow of fuel in to the combustion chamber, said rings being in contact with each other and having facing surfaces at least about said nozzle opening made of erosion-resistant material; and a second pair of rings threaded onto said valve body end with said first pair of rings clamped therebetween.

2. A fuel injection valve as set forth in claim 1 wherein said valve body end has an external conical surface and each of said first pair of rings has an internal conical surface facing said surface of said end.

3. A fuel injection valve as set forth in claim 1 which further comprises a pair of intermediate rings, each intermediate ring being disposed between a respective one of said first pair of rings and a respective one of said second pair of rings.

4. A fuel injection valve as set forth in claim 1 wherein at least one of said first pair of rings has a plurality of grooves in a facing surface thereof to define a plurality of circumferentially disposed nozzles.

5. A fuel injection valve as set forth in claim 4 wherein said valve body has an annular groove in said end between and in communication with said duct and said nozzles.

6. A fuel injection valve as set forth in claim 1 wherein one of said first pair of rings has a flat facing surface and the other ring of said first pair of rings has a groove facing said flat surface to define said nozzle.

7. A fuel injection valve as set forth in claim 6 wherein said groove has a cross-sectional shape defining three boundary surfaces to impart a rectangular shape to said groove.

8. A fuel injection valve as set forth in claim 1 wherein said rings are made of ceramic material.

9. A fuel injection valve as set forth in claim 1 which further comprises a coating about said nozzle of erosion-resistant material.

10. A fuel injection valve as set forth in claim 1 wherein said rings are made of cermet.

11. A fuel injection valve as set forth in claim 1 wherein said valve body includes a second duct in communication with said valve seat to deliver a flow of fuel thereto.

12. A fuel injection valve comprising a valve body having an end for projecting into a combustion chamber, a valve seat and a duct extending from said valve seat to said end to convey a flow of fuel thereto;

a valve needle movably mounted in said valve body for selectively seating on said valve seat to block a flow of fuel into said duct; and a first pair of rings removably mounted about said valve body end, at least one of said rings having a plurality of radially directed grooves in a facing surface thereof to define a plurality of circumferentially distributed nozzles therebetween communicating with said duct to exhaust a flow of fuel into the combustion chamber, said rings being in contact with each other and having facing surfaces at least about said nozzle openings made of erosion resistant material.

13. A fuel injection valve as set forth in claim 12 which further comprises a second pair of rings threaded onto said valve body end with said first pair of rings clamped therebetween.

14. A fuel injection valve as set forth in claim 12 wherein said valve body end has an external conical surface and each of said first pair of rings has an internal conical surface facing said surface of said end.

15. A fuel injection valve as set forth in claim 12 which further comprises a pair of intermediate rings, each intermediate ring being disposed between a respective one of said first pair of rings and a respective one of said second pair of rings.

* * * * *